US005462322A

United States Patent [19]

Berezansky

[11] Patent Number: 5,462,322

[45] Date of Patent: Oct. 31, 1995

[54] PORTABLE DOOR LOCK

[76] Inventor: Alex Berezansky, R.D. 2 Box 71, Seward, Pa. 15954

[21] Appl. No.: 285,284

[22] Filed: Aug. 3, 1994

[51] Int. Cl.[6] ..... E05B 13/00

[52] U.S. Cl. ..... 292/288; 292/291; 292/258

[58] Field of Search ..... 292/288, 291, 292/258, 305; 403/290

[56] References Cited

U.S. PATENT DOCUMENTS

| | | | |
|---|---|---|---|
| 11837675 | 5/1916 | Radtko | 292/305 |
| 1387765 | 8/1921 | Colonna | 292/305 |
| 2495860 | 1/1950 | Miller | 292/258 |
| 4082335 | 4/1978 | Smith | 292/291 |
| 4567660 | 2/1986 | Sakata et al. | 292/305X |
| 5000498 | 3/1991 | Upchurch | 292/288 |

FOREIGN PATENT DOCUMENTS

| | | | |
|---|---|---|---|
| 2426139 | 1/1980 | France | 292/258 |

*Primary Examiner*—Peter M. Cuomo
*Assistant Examiner*—Monica E. Millner
*Attorney, Agent, or Firm*—William J. Ruano

[57] ABSTRACT

A portable door lock operable from the inside of a door for selectively clamping or unclamping the door latch. Such door lock comprises two halves pivoted together centrally and having confronting serrated semi-circular openings at one end and screw means for selectively pivoting said halves at the other end.

1 Claim, 1 Drawing Sheet

PORTABLE DOOR LOCK

BACKGROUND OF THE INVENTION

Heretofore, no suitable portable door locks have been devised to prevent unauthorized unlatching of doors.

SUMMARY OF THE INVENTION

A portable door lock in the form of a pivotal clamp for clamping a door lock to prevent unauthorized unlocking.

DESCRIPTION OF THE PREFERRED EMBODIMENT

Numerals 1 and 2 denote clamp halves pivotally mounted on hinge 3. A slotted screw 4 engages threads in end portions 5 and 6 to selectively pivot the clamp halves 1 and 2 to either bring the opposite ends together or to move them apart, depending upon the direction of rotation of the screw 4, either by the use of a screwdriver or by hand. Said opposite ends preferably are serrated at 7 and 8 to enable firm clamping of the door latch (not shown) which they are adapted to surround by merely sliding the clamp halves 1 and 2 through the space between a door and the adjoining door frame, which space is about ⅛" wide, which restricts the width of the clamp halves to less than said space, such as to 1/16" wide.

Figure 1:
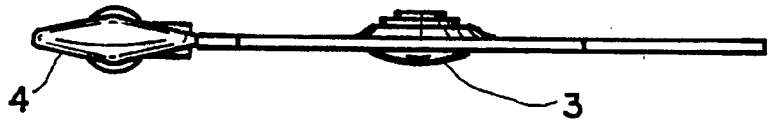
FIG. 1 is a top view.
Figure 2:
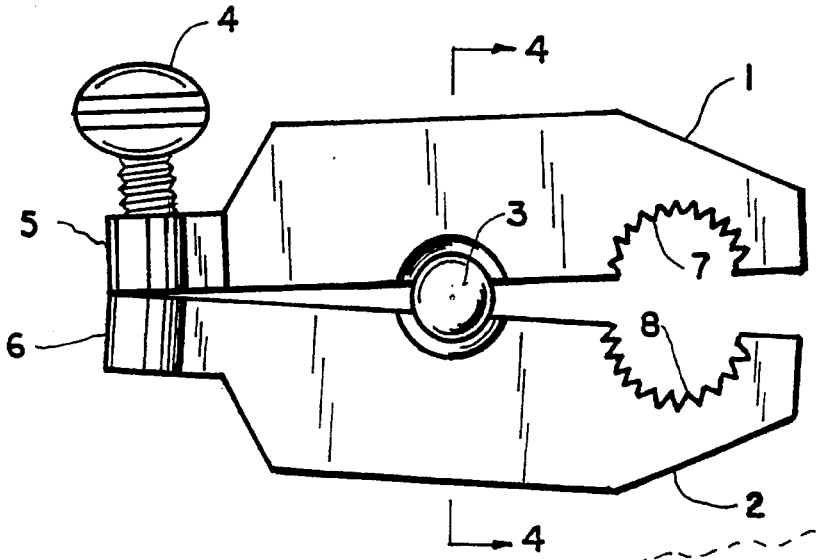
FIG. 2 is a side elevational view.
Figure 3:
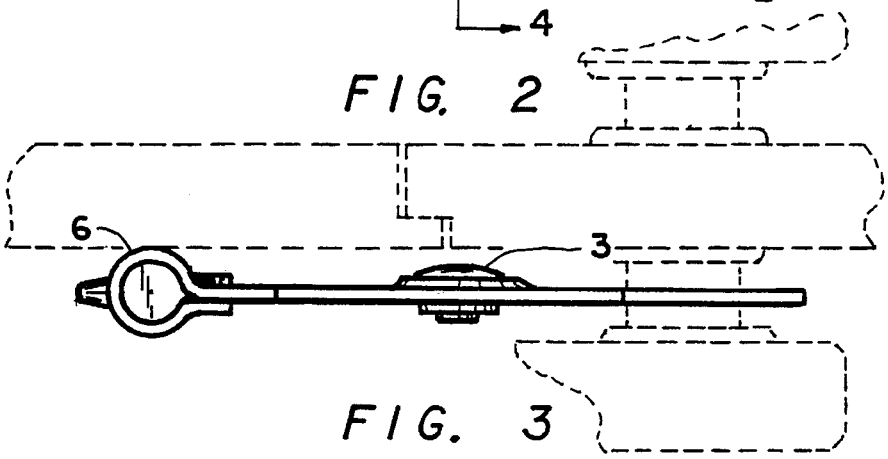
FIG. 3 is a bottom view of a portable door lock to prevent unauthorized unlatching.
Figure 4:
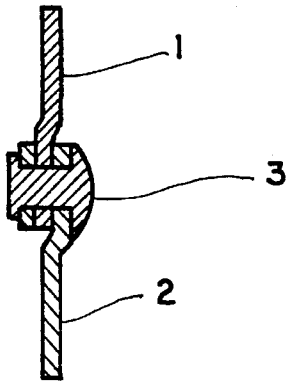
FIG. 4 is a vertical cross-sectional view taken along line 4—4 of FIG. 2.

In operation, when it is desired by the homeowner to clamp the door latch from the inside of the door, the portions of the clamp halves forward of the hinge 3 are inserted in the space between the door and the adjoining door frame while in the position shown in FIG. 2 and thereafter by turning screw in the direction to clamp the door latch, the serrated portions 7 and 8, the door latch is firmly held so as to prevent unauthorized unlatching.

While a screw 4 has been shown for effecting clamping of the door latch, equivalent means, such as a snap lock, cam or spring may be used instead for clamping and unclamping.

I claim:

1. A device for clamping a door latch from the inside of a door comprising a pair of clamp halves of a width of less than ⅛ inch wide pivotally connected together by a central pivot, each clamp half having, at one end portion, a substantially semi-circular serrated opening which confronts another substantially semi-circular serrated opening of the other clamp half for surrounding and clamping said door latch when the portions of said clamp halves having said serrated semi-circular openings are projected through the space between a door and door frame, each clamp half at the other end portion, means for pivoting said clamp halves in either direction, comprising a pair of adjoining internally threaded circular portions and a screw for engaging said internally threaded circular portions for selectively clamping or unclamping said serrated semicircular openings.

* * * * *